US007583278B2

(12) United States Patent
Shiomi et al.

(10) Patent No.: US 7,583,278 B2
(45) Date of Patent: Sep. 1, 2009

(54) DISPLAY DRIVE METHOD, DISPLAY, AND PROGRAM THEREFOR

(75) Inventors: Makoto Shiomi, Tenri (JP); Kazunari Tomizawa, Kyoto (JP); Koichi Miyachi, Kyoto (JP); Tomoo Furukawa, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 755 days.

(21) Appl. No.: 10/743,770

(22) Filed: Dec. 24, 2003

(65) Prior Publication Data

US 2004/0135799 A1 Jul. 15, 2004

(30) Foreign Application Priority Data

Dec. 27, 2002 (JP) ..... 2002-381583

(51) Int. Cl.
*G09G 3/36* (2006.01)
*G09G 5/10* (2006.01)

(52) U.S. Cl. ..... 345/690; 345/204; 345/87; 345/89

(58) Field of Classification Search ..... 345/690, 345/60–104, 204
See application file for complete search history.

(56) References Cited

U.S. PATENT DOCUMENTS 6,704,008 B2 * 3/2004 Naito et al. ..... 345/207
7,158,107 B2 * 1/2007 Kawabe et al. ..... 345/89
2002/0044115 A1 4/2002 Jinda et al.
2002/0167465 A1 11/2002 Okuno et al.
2003/0174110 A1 9/2003 Baba et al.
2006/0077161 A1 4/2006 Baba et al.

FOREIGN PATENT DOCUMENTS

| | | |
|---|---|---|
| JP | 3-174186 | 7/1991 |
| JP | 04-288589 | 10/1992 |
| JP | 09-034395 | 2/1997 |
| JP | 11-066311 | 3/1999 |
| JP | 2002-116743 | 4/2002 |
| JP | 2002-278500 | 9/2002 |
| JP | 2003-264846 | 9/2003 |

* cited by examiner

*Primary Examiner*—Duc Q Dinh
(74) *Attorney, Agent, or Firm*—Harness, Dickey & Pierce, P.L.C.

(57) ABSTRACT

Data, such as video signal data, for example, for a next desired frame is first modulated or varied to facilitate a transition from a current frame to a next desired frame. A modulation processing section can be used, for example, to thus produce a corrected video signal to facilitate the current-to-next desired grayscale level transition. Thereafter, spatial filtering is then carried on the corrected video signal, using a spatial filtering section for example. As such, high frequency components in a spatial domain may be reduced, even after the spatial frequencies of an ordinary video signal and potentially those of noise have been scaled up. Therefore, undesirable noise-caused display quality degradation can be reduced or even prevented, while pixel response speed as a result of the facilitation of grayscale level transition, is increased.

18 Claims, 9 Drawing Sheets

DISPLAY DRIVE METHOD, DISPLAY, AND PROGRAM THEREFOR

This Nonprovisional application claims priority under 35 U.S.C. § 119(a) on Patent Application No. 2002-381583 filed in Japan on Dec. 27, 2002, the entire contents of which are hereby incorporated by reference.

FIELD OF THE INVENTION

The present invention generally relates to a display drive method, display, and/or a program for the method.

BACKGROUND OF THE INVENTION

Liquid crystal displays with relatively low operating power are in widespread use not only in mobile devices but also in stationary types. In comparison to the CRT (Cathode-Ray Tube) and the like, the liquid crystal display is slow to respond and may fail to completely respond within a rewrite time (16.7 msec) which corresponds to a typical frame frequency (60 Hz) depending on grayscale level. The issue is addressed in, for example, Japanese published unexamined patent application 2002-116743 (Tokukai 2002-116743; published Apr. 19, 2002) by driving the LCD (Liquid Crystal Display) with a drive signal modulated for a quick transition from a current to a desired grayscale level.

For example, supposing that a grayscale level transition from a current frame FR(k−1) to a next or desired frame FR(k) requires a "rise" drive, a voltage is applied to a pixel in such a manner to facilitate a transition from the current grayscale level to a desired grayscale level. Specifically, a voltage applied to the pixel is higher than that represented by video data D(i,j,k) for the next frame FR(k).

In the grayscale level transition, the application of the voltage increases the brightness level of the pixel more quickly and takes less time to raise it to proximity to the brightness level indicated in the video data D(i,j,k) for the next frame FR(k) than the faithful application of an exact voltage represented by the video data D(i,j,k) for the next frame FR(k). Thus, the liquid crystal display will have an improved response speed despite the use of slow-responding liquid crystal.

In conventional arrangements, however, noise in a video signal may enhance a grayscale level transition and produce an undesirable video output. Meanwhile, if grayscale level transition facilitation is restrained to prevent display quality from being degraded due to the noise, the response speed of the pixel may slow down.

SUMMARY OF THE INVENTION

Conceived of the foregoing and/or other problems, an embodiment of the present invention may have an objective of offering a display, with improved pixel response speed, which is capable of reducing and possibly even preventing noise-caused display quality degradation.

Data is corrected to facilitate a transition from a current frame to a next desired frame. Thereafter, spatial filtering is then carried on the corrected video signal.

As such, high frequency components in a spatial domain may be reduced, even after the spatial frequencies of an ordinary video signal and potentially those of noise have been scaled up. Therefore, undesirable noise-caused display quality degradation can be reduced or even prevented, while pixel response speed as a result of the facilitation of grayscale level transition, is increased.

A program in accordance with an embodiment of the present invention causes a computer to execute the steps of a method of driving a display. A computer running the program may operate as a driver for the display. Therefore, similar to the aforementioned drive method, the display is capable of reducing or even preventing noise-caused display quality degradation despite improved pixel response speed.

A computer data signal in accordance with an embodiment of the present invention is an electrical representation of a respective aforementioned embodiment of a program. For example, if a computer receives the computer data signal embodied in a carrier wave or other signal and runs the program, the computer may drive the display with an embodiment of the drive methods. Any of the programs, when recorded on a computer readable storage medium, is readily stored and distributed. A computer reading the storage medium may drive the display with any of the drive methods.

For a fuller understanding of the nature and advantages of the invention, reference should be made to the ensuing detailed description of exemplary embodiments taken in conjunction with the accompanying drawings.

DETAILED DESCRIPTION OF THE EXEMPLARY EMBODIMENTS OF THE INVENTION

In one embodiment, data, such as video signal data for example, for a next desired frame is first modulated or varied to facilitate a transition from a current frame to a next desired frame. A modulation processing section can be used, for example, to thus produce a corrected video signal to facilitate the current-to-next desired grayscale level transition. Thereafter, spatial filtering is then carried on the corrected video signal, using a spatial filtering section for example.

As such, high frequency components in a spatial domain may be reduced, even after the spatial frequencies of an ordinary video signal and potentially those of noise have been scaled up. Therefore, undesirable noise-caused display quality degradation can be reduced or even prevented, while pixel response speed as a result of the facilitation of grayscale level transition, is increased.

The following will describe an embodiment of the present invention with reference to FIG. 1 through FIG. 13. An image display (display) 1 in accordance with the present embodiment facilitates a current-to-next (desired) grayscale level transition to improve pixel response speed, but is still capable of preventing noise-caused display quality degradation.

Figure 2:
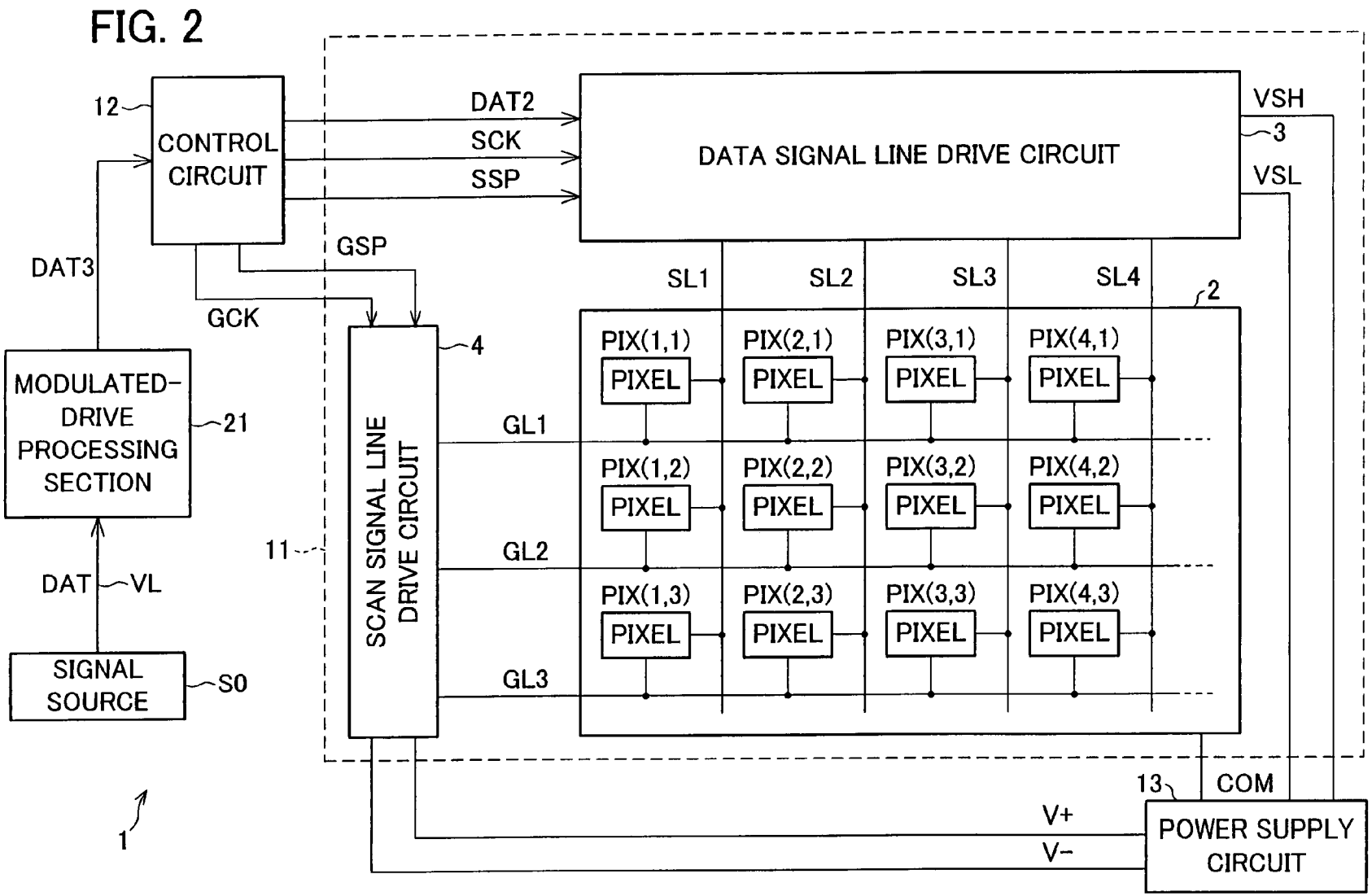
FIG. 2 is a block diagram showing the configuration of a major part of the image display.

Referring to FIG. 2, a panel 11 of the image display 1 is provided with: a pixel array 2 of pixels PIX(1,1) to PIX(n,m) arranged in a matrix; a data signal line drive circuit 3 driving data signal lines SL1-SLn for the pixel array 2; and a scan signal line drive circuit 4 driving scan signal lines GL1-GLm for the pixel array 2. The image display 1 further is provided with: a control circuit 12 supplying control signals to the drive circuits 3, 4; and a modulated-drive processing section 21 modulating video signals fed to the control circuit 12 so as to facilitate grayscale level transitions based on incoming video signals. These circuits are powered by a power supply circuit 13.

Before describing the construction of the modulated-drive processing section 21 in detail, the overall construction and operation of the image display 1 will be described briefly. For convenience in description, reference numerals have an alphanumeric suffix identifying the individual member's position, as in "SLi" referring to the i-th data signal line, only when necessary; the suffixes are omitted when not necessary or when the numerals refer collectively to a group of identical members.

The pixel array 2 has the multiple (n in this example) data signal lines SL1-SLn and the multiple (m in this example) scan signal lines GL1-GLm provided to cross the data signal lines SL1-SLn. A pixel PIX(i,j) is provided for each combination of a data signal line SLi and a scan signal line GLj, where i is an integer from 1 to n and j is an integer from 1 to m.

In the present embodiment, each pixel PIX(i,j) is surrounded by two adjacent data signal lines SL(i−1), SLi and two adjacent scan signal lines GL(j−1), GLj.

Figure 3:
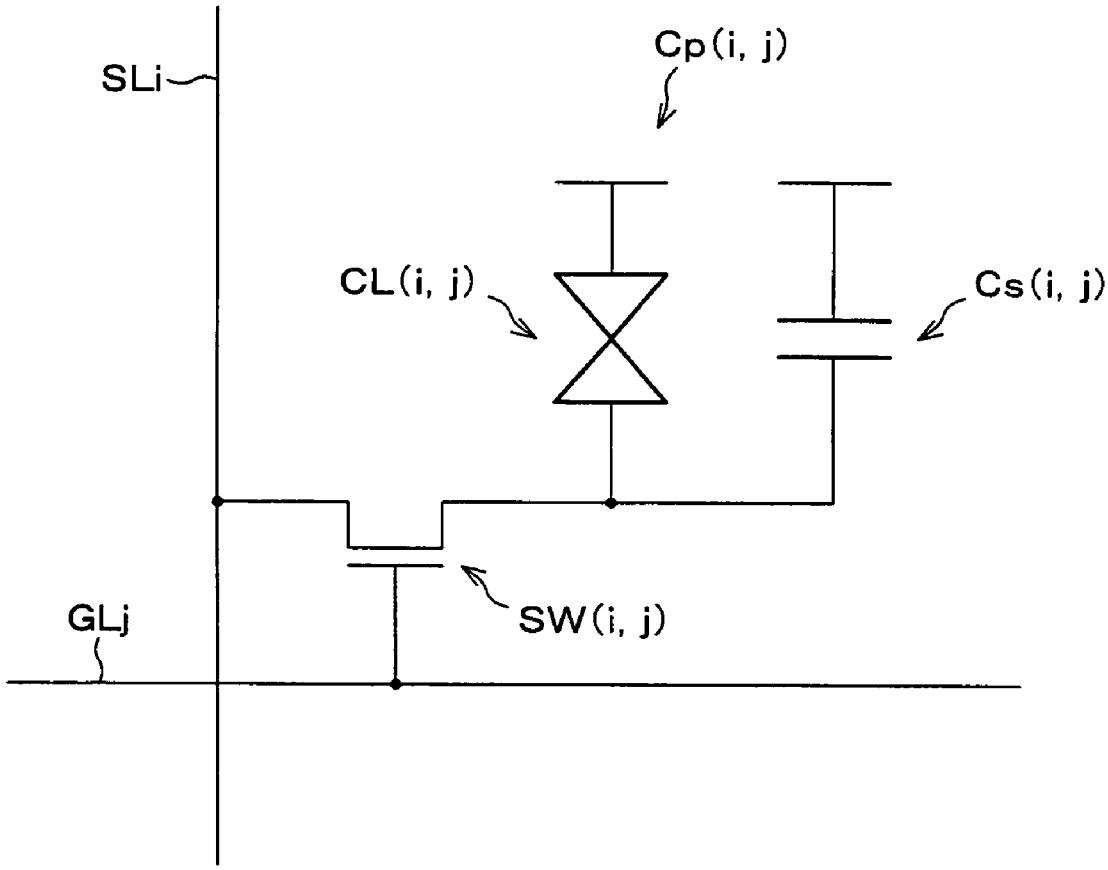
FIG. 3 is a circuit diagram showing, as an example, the structure of a pixel in the image display.

An example of the pixel PIX(i,j) is shown in FIG. 3 where the image display 1 is a liquid crystal display. In the example in FIG. 3, the pixel PIX(i,j) includes a field effect transistor SW(i,j) acting as a switching device, with the gate and drain connected respectively to the scan signal line GLj and data signal line SLi. The pixel PIX(i,j) further includes a pixel capacitor Cp(i,j) one of the electrodes of which is connected to the source of the field effect transistor SW(i,j); the other electrode is connected to a common electrode line shared by all the pixels PIX. The pixel capacitor Cp(i,j) is constructed from a liquid crystal capacitance CL(i,j) and an auxiliary capacitance Cs(i,j) added where necessary.

The pixel PIX(i,j) operates as follows: Selecting the scan signal line GLj turns on the field effect transistor SW(i,j), causing the voltage on the data signal line SLi to appear across the pixel capacitor Cp(i,j). Then, the scan signal line GLj is deselected to turn off the field effect transistor SW(i,j), causing the pixel capacitor Cp(i,j) to retain the voltage at the turn off. Since liquid crystal transmittance and reflectance vary depending on the voltage across the liquid crystal capacitance CL(i,j), the display state of the pixel PIX(i,j) changes according to video data D if a voltage is applied to the data signal line SLi in accordance with the video data D while the scan signal line GLj is being selected.

The liquid crystal display in accordance with the present embodiment uses liquid crystal cells of vertical align mode. With no voltage applied, liquid crystal molecules are aligned substantially vertical to the substrate. The molecules incline off the vertical align state in accordance with the voltage across the liquid crystal capacitance CL(i,j) of the pixel PIX (i,j). In the liquid crystal display in accordance with the present embodiment, the liquid crystal cells of vertical align mode are used in normally black mode (the display appears dark under no voltage application).

Referring back to FIG. 2 showing the construction under consideration, the scan signal line drive circuit 4 feeds the scan signal lines GL1-GLm with a signal indicative of a select period, such as a voltage signal. The scan signal line drive circuit 4 selects the scan signal line GLj to which to supply the select period signal, according to a clock signal GCK, a start pulse signal GSP, and other timing signals from the control circuit 12. The scan signal lines GL1-GLm are hence sequentially selected at predetermined timings.

The data signal line drive circuit 3 samples a time division video signal DAT at predetermined timings for video data D for the pixels PIX. The data signal line drive circuit 3 outputs signals to the data signal lines SL1-SLn in accordance with the video data D. The lines SL1-SLn then pass on the signals to the pixels PIX(1,j) to PIX(n,j) which are being selected through the scan signal line GLj by the scan signal line drive circuit 4.

The data signal line drive circuit 3 determines output timings for the samplings and signal outputs according to a clock signal SCK, a start pulse signal SSP, and other timing signals fed from the control circuit 12.

The brightness of the pixels PIX(1,j) to PIX(n,j) is changed by adjusting projected light quantity, transmittance, etc. through the respective signals fed to the data signal lines SL1-SLn while the corresponding scan signal line GLj is being selected.

With the scan signal lines GL1-GLm sequentially selected by the scan signal line drive circuit 4, the pixels PIX(1,1) to PIX(n,m) of the pixel array 2 are set to the brightness (grayscale level) indicated by the respective video data D, allowing for an update of the image displayed by the pixel array 2.

With the image display 1, the video signal DAT may be transferred frame by frame from a video signal source S0 to the modulated-drive processing section 21. A "frame" here refers to a sufficient amount of data for the production of a display across the screen. Alternatively, each frame is divided up into fields, and the signal DAT may be transferred a field at a time. The following description will assume that the transfer takes place field by field as an example.

In the present embodiment, the frames of the video signal DAT are each divided into two fields and transferred field by field from the video signal source S0 to the modulated-drive processing section 21.

Specifically, to transfer the video signal DAT through the video signal line VL to the modulated-drive processing section 21 in the image display 1, the video signal source S0 completely transfers video data for a field before transferring video data for a next field. Video data is thus transferred by time division for each field.

A field is made up of horizontal lines. Each field is transferred via the video signal line VL by completely transferring all video data for a line before transferring video data for a next line. Video data is thus transferred by time division for each line.

In the present embodiment, each frame is made up of a pair of fields. In an even numbered field, video data is transferred for even numbered ones of the horizontal lines forming the frame. In an odd numbered field, video data is transferred for odd numbered ones. The video signal source S0 further time divides video data for each horizontal line and sends it down the video signal line VL in a predetermined sequence.

Figure 1:
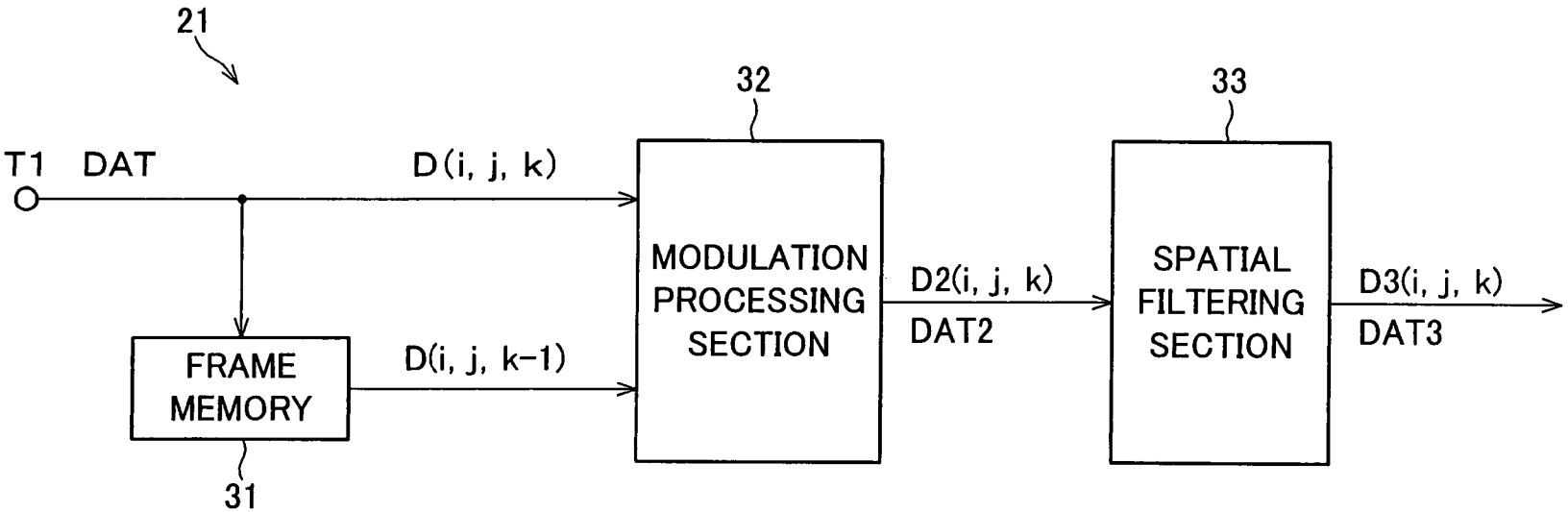
FIG. 1 is a block diagram showing the configuration of a major part of a modulated-drive processing section of an image display in accordance with and embodiment of the present invention.

As shown in FIG. 1, the modulated-drive processing section 21 in accordance with the present embodiment includes a frame memory 31, a modulation processing section (first correction section) 32, and a spatial filtering section (determination section, second correction section) 33.

The frame memory 31 stores a frame of video data D(i,j,k) fed from an input terminal T1. The modulation processing section 32 modulates the video data D(i,j,k) for a next or desired frame FR(k) on the basis of video data D(i,j,k−1) for the current frame FR(k−1), and thus outputs of corrected video data D2(i,j,k). As such, the current-to-desired next grayscale level transition is facilitated.

The video data D(i,j,k−1) for the current frame FR(k−1) is to be fed to the same pixel PIX(i,j) as the video data D(i,j,k) and read from the frame memory 31. The spatial filtering section 33 performs spatial filtering on corrected video signal DAT2 output from the modulation processing section 32 to reduce or even restrain some or all high frequency components in a spatial domain. The output of the spatial filtering section 33, i.e., video signal DAT3, is supplied to the control circuit 12 shown in FIG. 2. The data signal line drive circuit 3 drives each pixel PIX(i,j) on the basis of the corrected video signal DAT3.

With the construction, video data D3(i,j,k) for a pixel PIX (i,j) is to generated as in the following: The modulation processing section 32 first facilitates a grayscale level transition from the video data D(i,j,k−1) for the current frame FR(k−1) to video data D(i,j,k) for the next desired frame FR(k) to generate the corrected video data D2(i,j,k). Next, the spatial filtering section 33 reduce or even restrain some or all high frequency components of the corrected video signal DAT2 carrying corrected video data D2 to the pixels PIX in a spatial domain to generate the video signal DAT3.

In other words, for sufficiently low spatial frequency components of the corrected video signal DAT2, the corrected video data D2(i,j,k) may be output as video data D3(i,j,k) without modification. Thus, the current-to-desired next grayscale level transition is facilitated for the video data D3(i,j,k). The pixels PIX(i,j) driven according to the video data D3(i,j,k) therefore respond at sufficient speed.

The video data D(i,j,k) is mostly continuous both in temporal and spatial domains, whereas noise is isolated in both domains and contains more high spatial frequency components. Therefore, when noise is introduced to the video data D(i,j,k) to be fed to the modulated-drive processing section 21, a grayscale level transition from the video data D(i,j,k−1) for the current frame FR(k−1) to the video data D(i,j,k) in many cases becomes undesirable when compared to ordinary transitions.

The modulation processing section 32 facilitates the current-to-desired next grayscale level transition. Therefore, the corrected video data D2(i,j,k) output of the modulation processing section 32 indicates undesirable or unacceptable grayscale level transition. On the other hand, normal video signal (containing no or an acceptable level of noise) is in most cases continuous in both temporal and spatial domains.

Therefore, the corrected video data D2, generated by correcting the video data D with no or an acceptable level of noise, does not facilitate the grayscale level transition as much as the corrected video data D2(i,j,k) containing noise. Thus, with the corrected video signal DAT2, the grayscale level as indicated by the corrected video data D2(i,j,k) containing an unacceptable level of noise becomes relatively unacceptable.

Accordingly, in the present embodiment, the spatial filtering section 33 is provided after the modulation processing section 32. The provision enables high frequency components to be reduced or even restrained by the spatial filtering section 33 even if the corrected video data D2(i,j,k) containing an unacceptable level of noise, represented by the corrected video signal DAT2, indicates too high a grayscale level, and the corrected video data D2(i,j,k) indicates too high spatial frequencies. As a result, the video signal DAT3 output of the spatial filtering section 33 represents video data D3(i,j,k) indicating a more acceptable (less excessive) grayscale level.

Hence, the pixel PIX(i,j) can respond at sufficiently high speed to normal video signal DAT with no or an acceptable level of noise. Where noise is introduced, undesirable facilitation of a grayscale level transition is reduced, and the displayed image becomes less susceptible to noise. Therefore, the image display in accordance with the present embodiment as a whole responds to video signals at high speed and reduces or even prevents instantaneous bright spots and color defective spots, capable of displaying well-balanced video.

In the construction, the spatial filtering section 33 is provided after the modulation processing section 32. Noise is thereby reduced or even removed from the corrected video signal DAT2, produced by the modulation processing section 32 which may have facilitated a potentially noise-caused grayscale level transition.

To describe in more detail, since the modulation processing section 32 facilitates the grayscale level transition, the corrected video signal DAT2 shows greater difference between spatial frequencies containing noise and those containing no or an acceptable level of noise than the video signal DAT. Therefore, when compared to a construction where the spatial filtering section 33 is provided before the modulation processing section 32, the spatial filtering section 33 in accordance with the present embodiment reliably reduces or even removes effects of noise on displayed images, even if the video signal DAT shows small difference between the spatial frequencies with and without noise.

Now, operation of the modulated-drive processing section 21 when noise is introduced will be described, in comparison to a construction with no spatial filtering section 33 and another with a spatial filtering section 33 before the modulation processing section 32. The following description will assume that the spatial filtering section 33 is a filter reducing or cutting off a peak in consideration of the corrected video data D2 to the left/right as an example.

Figure 4:
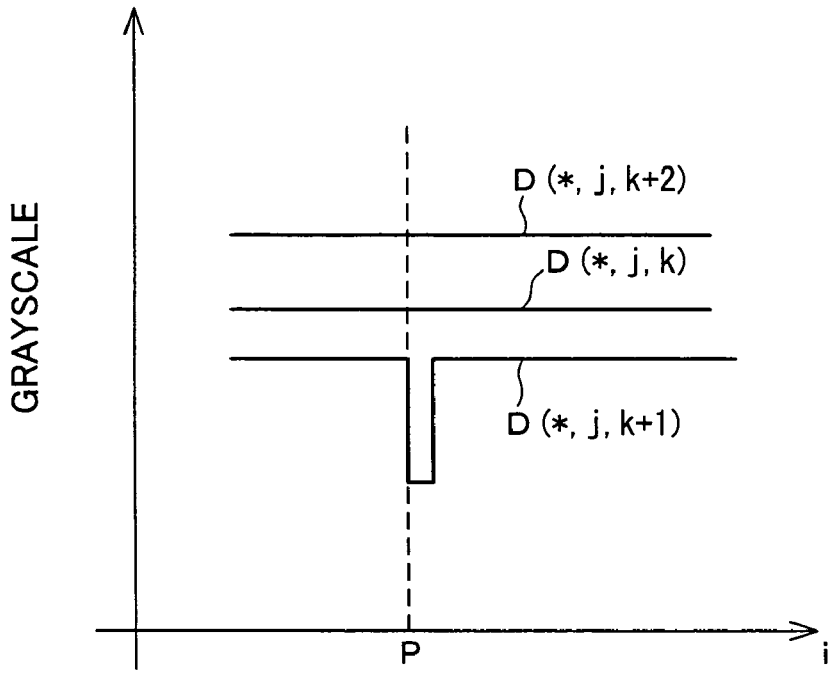
FIG. 4 is a graph showing, as an example, video signals fed to the modulated-drive processing section.

An example will be first described where video data D(*,j,k), D(*,j,k+1), and D(*,j,k+2) shown in FIG. 4 are sequentially fed to a horizontal line L(j) in the frames FR(k), FR(k+1), and FR(k+2) respectively. In FIGS. 4 to 11, the horizontal axis shows a position i of the pixel PIX(i,j) on the horizontal line L(j) corresponding to the video data, and the vertical axis shows the grayscale level for the video data.

In the example shown in FIG. 4, in the frame FR(k), the video data D(*,j,k) indicates a substantially uniform grayscale level across the horizontal line L(j). In the next frame FR(k+1), basically, video data D(i,j,k+1) indicates grayscale levels lower than the video data D(*,j,k) across the horizontal line L(j). In the next frame FR(k+2), video data D(*,j,k+2) indicates a higher grayscale level than the video data D(*,j,k) across the horizontal line L(j).

In the frame FR(k+1), noise may be present in the video data D(p,j,k+1) at a specific position (i=p). At the position, the video data D(p,j,k+1) indicates a reduced grayscale level, which should be substantially equal to those at the other positions on the horizontal line L(j).

When the video data is input, the modulation processing section 32 facilitates a grayscale level transition from the current frame to the next desired frame. In other words, the modulation processing section 32 outputs corrected video data D2(*,*j,k*), D2(*,*j,k*+1), and D2(*,*j,k*+2) shown in FIG. 5 in the frames FR(k), FR(k+1), and FR(k+2) respectively.

Here, the corrected video signal DAT2 indicates a grayscale level transition facilitated by the modulation processing section 32. Therefore, in the frame FR(k+1), the grayscale level indicated by the corrected video data D2(*,*j,k*+1) is lower than that indicated by the uncorrected video data D(*,j,k+1). In addition, as a result of the grayscale level transition, the noise-caused change in grayscale level, i.e., the difference in grayscale level between the corrected video data D2(p,j,k+1) at the specific position and the corrected video data D2(i,j,k+1) at the other positions, is greater than the difference in grayscale level between the uncorrected video data D(p,j,k+1) at the specific position and the video data D(i,j,k+1) at the other positions.

Further, although no or an acceptable level of noise may be present in the frame FR(k+2), an unacceptable level of noise may be present in the video data D(p,j,k+1) in the current frame FR(k+1). Therefore, the grayscale level indicated by the corrected video data D2(p,j,k+2) at the specific position in the frame FR(k+2) may be relatively higher than the corrected video data D2(i,j,k+2) at the other positions. The grayscale level transition may have further made the noise-caused difference in grayscale level greater than that in uncorrected grayscale level.

As discussed in the foregoing, with the corrected video signal DAT2, a noise-caused change in grayscale level may occur not only in the frame FR(k+1) where noise is present, but also in the next desired frame FR(k+2). The change (level difference) may be greater than the level difference caused by the noise in the video signal DAT.

Therefore, in a comparative example where no spatial filtering section 33 is provided, and the corrected video signal DAT2 output of the modulation processing section 32 is fed to the control circuit 12, the noise in the video signal DAT may affect the image displayed by the image display for an extended period of time. To a greater extent, it may seriously degrade the display quality of the image display.

Further, as mentioned in the foregoing, if noise is present in a frame FR(k+1) of the video signal DAT, the noise causes level changes of opposite directions in the frame FR(k+1) and the next frame FR(k+2) with the corrected video signal DAT2. Therefore, when the pixel PIX fails to reach a desired grayscale level despite facilitation of grayscale level transition to address slow response speed, if the grayscale level transition is facilitated in the next frame FR(k+2). Assuming that a grayscale level transition from the previous frame FR(k) to the current frame FR(k+1) is sufficient, the grayscale level transition may not be suitably facilitated and may further degrade the display quality of the image display.

Figure 12:
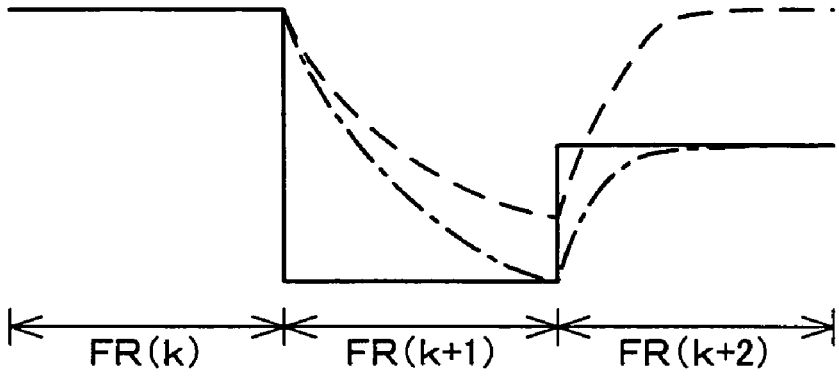
FIG. 12 is a timing chart showing actual brightness levels when the previous-to-next grayscale level transition is a "fall" followed by a "rise."
Figure 13:
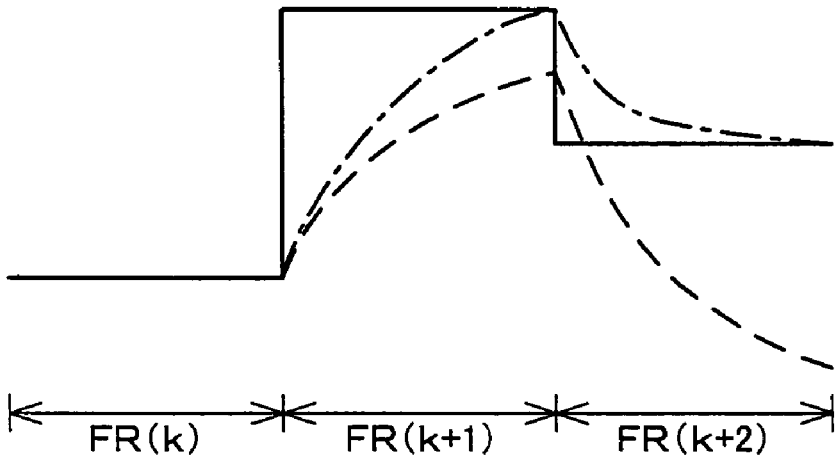
FIG. 13 is a timing chart showing actual brightness levels when the previous-to-next grayscale level transition is a "rise" followed by a "fall."

FIGS. 12, 13 show specific examples of such events. FIG. 12 shows an example where the previous-to-next desired grayscale level transition (solid line in the figure) is a "fall" followed by a "rise." In the examples in the figure, as indicated by a broken line, the previous-to-current grayscale level transition is insufficient, and the brightness level at the start of the current frame FR(k+1) has not sufficiently decreased. In such a case, if the pixel is driven similarly to a case where a sufficient grayscale level transition has taken place in the next frame FR(k+2) (dash-dot line in the figure), the grayscale level transition is facilitated excessively, causing excess and undesirable brightness.

FIG. 13 shows an example where the previous-to-next desired grayscale level transition (solid line in the figure) is a "rise" followed by a "fall." In the examples in the figure, as indicated by a broken line in the figure, the previous-to-current grayscale level transition is insufficient, and the brightness level at the start of the current frame FR(k+1) has not sufficiently risen. In such a case, if the pixel is driven similarly to a case where a sufficient grayscale level transition has taken place in the next frame FR(k+2) (dash-dot line in the figure), the grayscale level transition is facilitated excessively, causing undesirable poor brightness.

Figure 5:
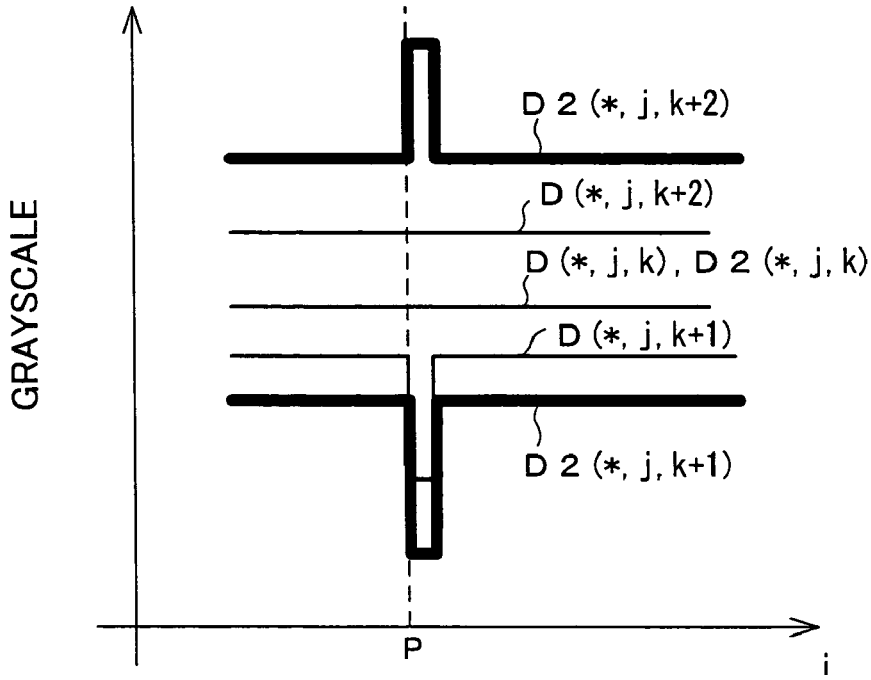
FIG. 5, illustrating operation of a comparative example, is a graph showing outputs from a modulated-drive processing section of a comparative example upon receipt of the video signals.

Therefore, when the corrected video data D2 (corrected video signal DAT2) in FIG. 5 is fed to the control circuit 12, since the grayscale level transition of the pixel PIX(p,j) from the frame FR(k) to the frame FR(k+2) is a "fall" followed by a "rise," the grayscale level transition of the pixel PIX(p,j) is facilitated excessively in the frame FR(k+2) and causes excess and undesired brightness unless the pixel PIX(p,j) has a sufficient response speed. FIG. 5 depicts downward noise (reducing the grayscale level) in the video data D(i,j,k+1) to the pixel PIX(p,j) as an example. If upward noise (increasing the grayscale level) is present, poor brightness may occur.

Figure 6:
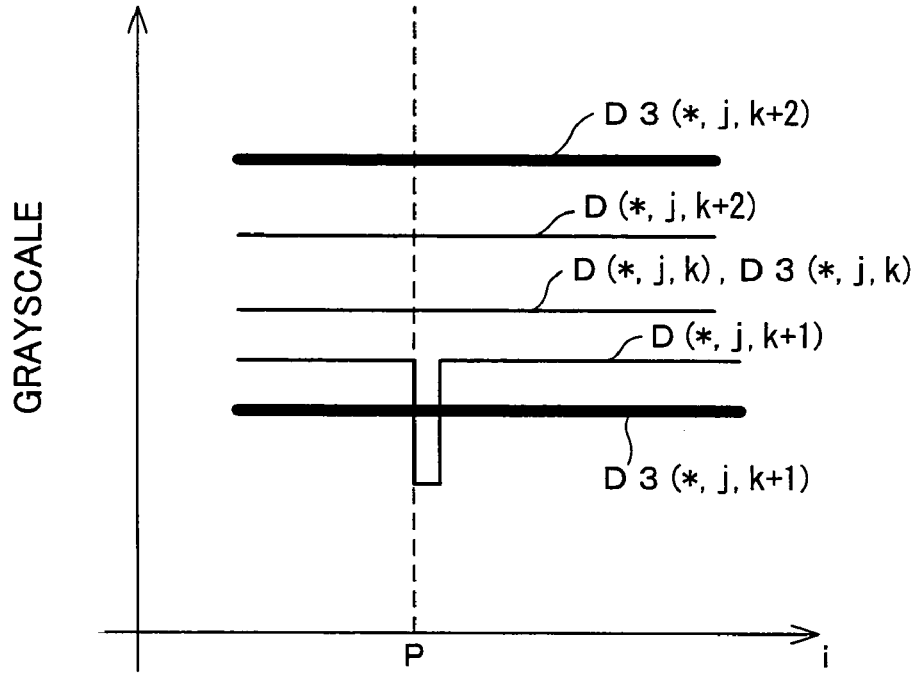
FIG. 6, illustrating operation of the foregoing embodiment, is a graph showing outputs from a modulated-drive processing section in accordance with the present embodiment upon receipt of the video signals.

In contrast, the modulated-drive processing section 21 in accordance with an embodiment includes the spatial filtering section 33 after the modulation processing section 32. The spatial filtering section 33 reduces or even eliminates peaks from the corrected video data D2 in consideration of the corrected video data D2 to the left/right (a "i<p" region and a "i>p" region). Thus, as shown in FIG. 6, video data D3(*,j,k+1) may be generated from which changes in the corrected video data D2(p,j,k+1) are reduced or even eliminated.

Thus, with the video signal DAT3 in accordance with the present embodiment, the video data D3(*,j,k+1) in the frame FR(k+1) is maintained at a substantially constant grayscale level. In addition, effects of noise are reduced or even removed from the video signal DAT3 in the frame FR(k+1); and unlike the case shown in FIG. 5, effects of noise are not as prevalent or are not even present in the frame FR(k+2) either.

As a result, although noise may be present in the frame FR(k+1), with the video signal DAT, the image displayed on the image display 1 does not experience a noise-caused grayscale level change. Thus, a high display quality of the image display 1 is maintained.

Figure 7:
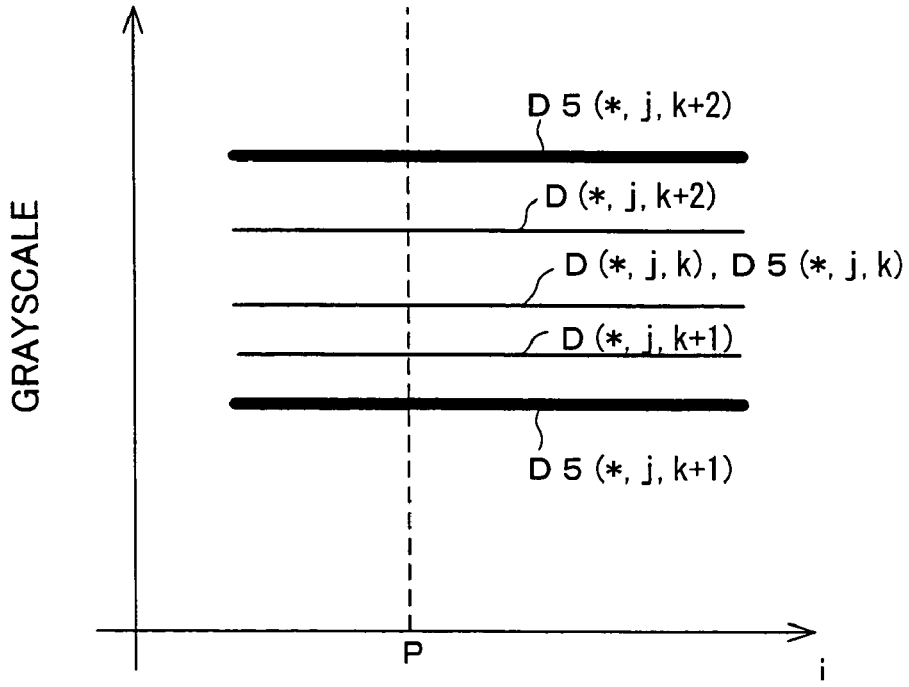
FIG. 7, illustrating operation of another comparative example, is a graph showing outputs from a modulated-drive processing section of a comparative example upon receipt of the video signals.

Incidentally, in the example shown in FIG. 5, the spatial frequency where unacceptable noise is present (1 pixel) is much higher than that where no or an acceptable level of noise is present, both for the video signal DAT and for the corrected video signal DAT2. Therefore, even in an arrangement where the spatial filtering section 33 is provided before the modulation processing section 32, and the video signal DAT5 produced by removing noise-caused high frequency components in a spatial domain from the video signal DAT is fed to the modulated-drive processing section 21, the modulation processing section 32 is capable, as shown in FIG. 7, of feeding the control circuit 12 with the corrected video data D5(*,j,k), D5(*,j,k+1), and D5(*,j,k+2) from which noise-caused grayscale level transitions are removed.

Figure 8:
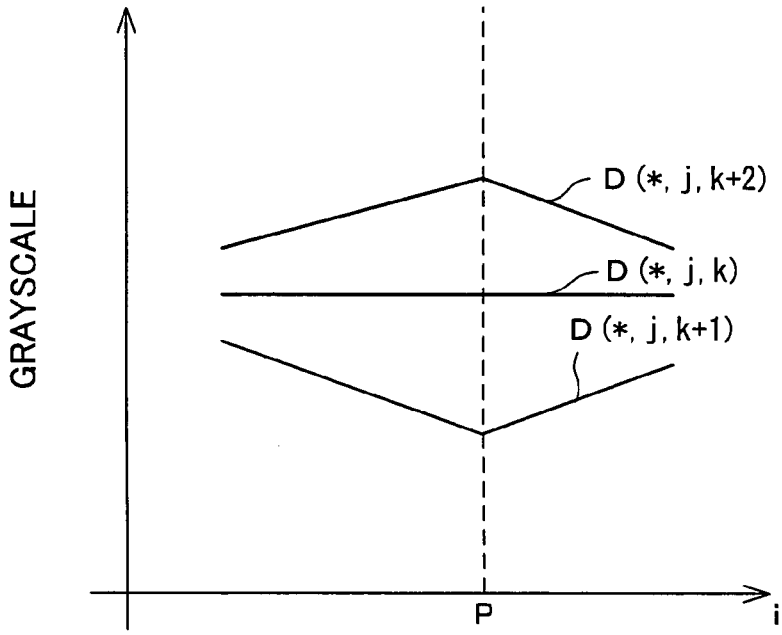
FIG. 8 is a graph showing, as another example, video signals fed to the modulated-drive processing section.

Nevertheless, when noise as shown in FIG. 8, has for example caused a grayscale level transition through relatively gentle gradation in comparison to FIG. 4, it is difficult to remove the noise in an arrangement with no spatial filtering section 33 or an arrangement where the spatial filtering section 33 is provided before the modulated-drive processing section 21.

Figure 9:
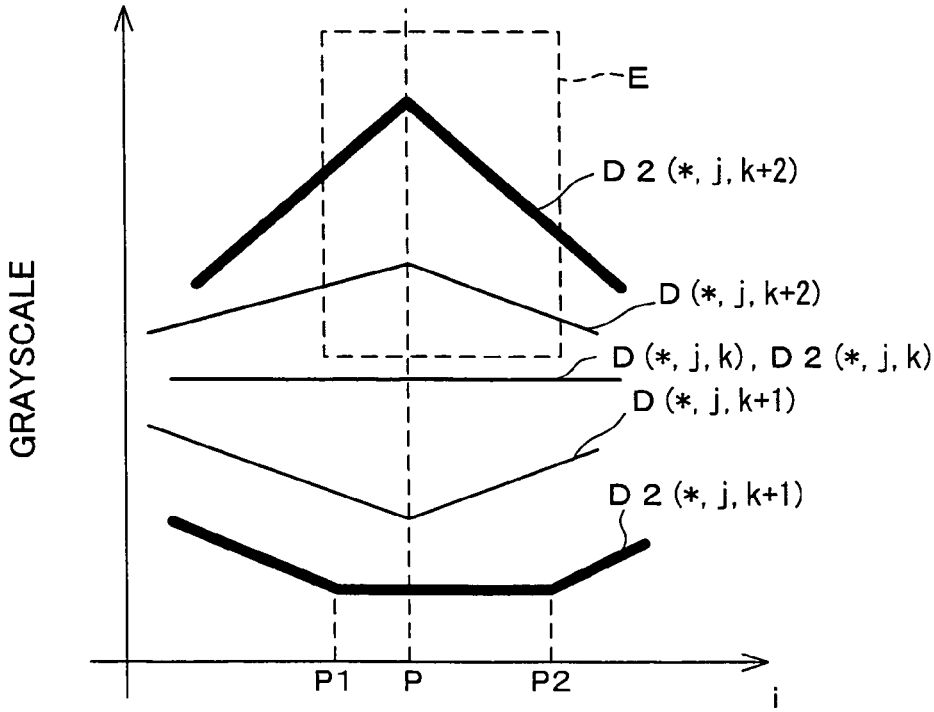
FIG. 9, illustrating operation of the comparative example, is a graph showing outputs from a modulated-drive processing section of a comparative example upon receipt of the video signals.
Figure 10:
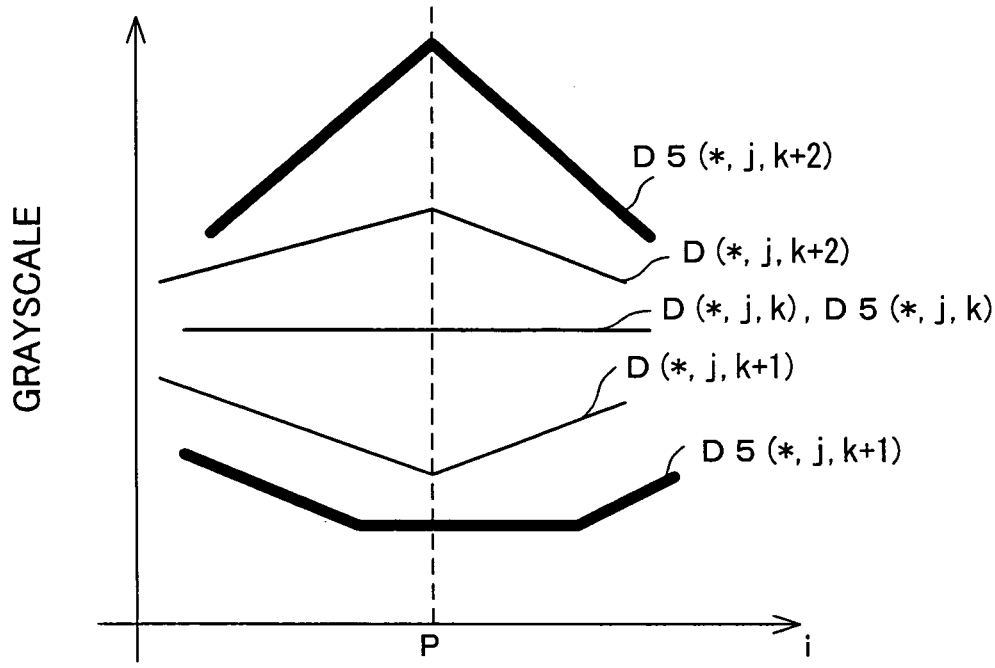
FIG. 10, illustrating operation of the other comparative example, is a graph showing outputs from a modulated-drive processing section of the comparative example upon receipt of the video signals.

FIG. 9 shows video data D2 supplied from the modulation processing section 32 when video signal D as shown in FIG. 8 is fed to the input terminal T1 in an arrangement with no spatial filtering section 33. FIG. 10 shows corrected video data D5 supplied from the modulation processing section 32 to the control circuit 12 when video signal D as shown in FIG. 8 is supplied to the input terminal T1 in an arrangement where the spatial filtering section 33 is provided before the modulated-drive processing section 21.

In the example in FIG. 8, the video data D(*,j,k) is maintained at a substantially constant level in the frame FR(k). However, in the frame FR(k+1), the presence of noise deforms the video data D(*,j,k+1) as will be explained as follows.

The video data D(p,j,k+1) at the specific position (i=p) shows a downward peak. To the left where i<p, the video data D(i,j,k+1) decreases with an increase in i at a substantially constant rate. To the right where i>p, the video data D(i,j,k+1) increases at a substantially constant rate.

In the frame FR(k+2), the presence of noise deforms the video data D(*,j,k+1) as follows: The video data D(p,j,k+2) at the specific position (i=p) shows an upward peak. To the left, the video data D(i,j,k+1) increases with an increase in i at a substantially constant rate. To the right, the video data D(i,j,k+1) decreases at a substantially constant rate.

When such video signal DAT is received, in the arrangement with no spatial filtering section 33, the modulation processing section 32 outputs the corrected video data D2(*,j,k), D2(*,j,k+1), and D2(*,j,k+2) shown in FIG. 9 in the frames FR(k), FR(k+1), and FR(k+2) respectively.

Here, the corrected video signal DAT2 indicates a grayscale level transition facilitated by the modulation processing section 32. Therefore, in the frame FR(k+1), the grayscale level indicated by the corrected video data D2(*,j,k+1) is lower than that indicated by the uncorrected video data D(*,j,k+1).

The modulation processing section 32 attempts to sharpen the peak in the spatial domain of the video signal DAT by facilitating a grayscale level transition. Nevertheless, the grayscale level indicated by the corrected video data D2 is generally restricted to a predetermined range in terms of the extent of grayscale level transition facilitation due to, for example, the arrangement of the drive circuit, the method of driving the pixel, or the grayscale range which a video signal can represent. FIG. 9 shows, as an example, the lower limit value of the grayscale level for the corrected video data D2 is limited to TA.

Therefore, if the extent of grayscale level transition facilitation for the corrected video data D2 is restricted, the modulation processing section 32 cannot sufficiently sharpen the video signal DAT. Therefore, the corrected video data D2(*,j,k+1) shows approximately the lower limit value TA in the proximity to the specific position (p1<p<p2). To the left, the corrected video data D2(*,j,k+1) decreases with an increase in i at a substantially equal rate to the video signal DAT. To the right, the corrected video data D2(*,j,k+1) increases at a substantially equal rate to the video signal DAT.

Similarly, in the frame FR(k+2), the modulation processing section 32 again facilitates a grayscale level transition, generating the corrected video signal DAT2. However, the example in FIG. 9 is a case where the grayscale level indicated by corrected video signal DAT indicates a value near the lower limit value, in which case the modulation processing section 32 can sufficiently sharpen the peak in the spatial domain of the video signal DAT. Therefore, the grayscale level indicated by the corrected video data D2(*,j,k+2) is higher and changes more abruptly than that indicated by the uncorrected video data D(*,j,k+2).

Especially, in the FIG. 9 example, as mentioned earlier, the video data D(*,j,k) in the frame FR(k+1) changes in a spatial domain so that the proximity to the specific position (i=p) is the bottom (downward peak). Therefore, the video data D(*,j,k+2) in the frame FR(k+2) changes even more abruptly. As a result, in a comparative example where the corrected video signal DAT2 is fed to the control circuit 12 (the spatial filtering section 33 is removed), a noise-caused grayscale level transition becomes visible in the E region in FIG. 9.

Here, in the FIG. 8 example, the spatial frequency of noise present in the video signal DAT is lower than in FIG. 4, and the noise-caused grayscale level changes are like gradation. As discussed in the foregoing, when the spatial frequency of noise is close to video signal DAT, as another comparative example, in an arrangement where the spatial filtering section 33 is provided before the modulation processing section 32, the spatial filtering section 33 may not be able to remove noise from the video signal DAT.

FIG. 10 shows that the video signal D as shown in FIG. 8 is supplied to the input terminal T1 and is not rid of noise in an arrangement where the spatial filtering section 33 is provided before the modulation processing section 32. In this case, a noise-caused grayscale level transition is visible similarly to the case in FIG. 9.

Figure 14:
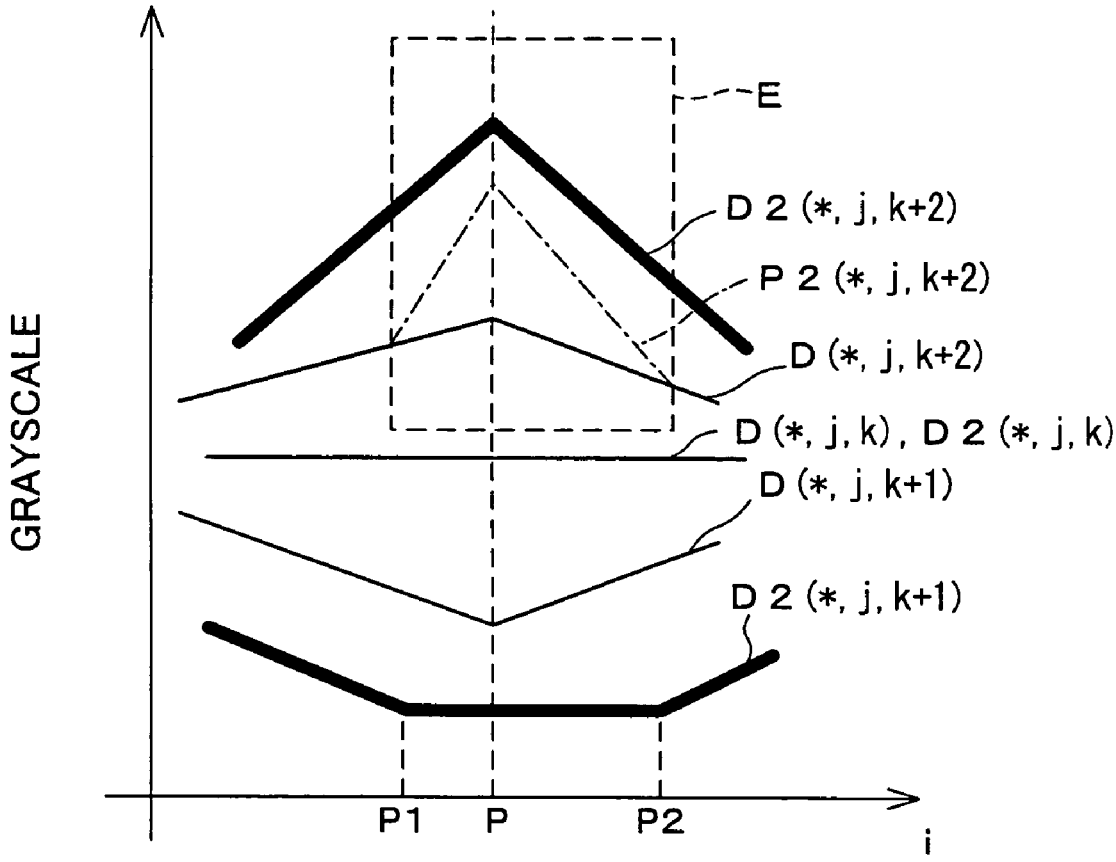
FIG. 14, illustrating operation of the comparative examples, is a graph showing grayscale level levels when the video signals are fed to the modulated-drive processing sections of the comparative examples.

Especially, in the examples shown in FIGS. 9, 10, in the proximity to the specific position (p1<p<p2), the grayscale levels indicated by the corrected video data D2(*,j,k+2) and D5(*,j,k+2) are saturated at the lower limit value. Therefore, when the signal shown in FIGS. 9, 10 is fed to the pixel PIX, the response speed is insufficient as shown in FIG. 12, causing excess or undesired brightness. In this case, as shown in FIG. 14, in the frame FR(k+2), the grayscale level of the pixel PIX exceed the grayscale level indicated by the video data D across the proximity to the specific position, causing visible excess or undesired brightness across that proximity.

Here, if the spatial filtering section 33 provided before the modulation processing section 32 performs filtering to such an extent that noise can be removed, noise may be removed, but high frequency components in a spatial domain may be removed from ordinary video signal DAT. As such, the images may lose sharpness.

In contrast, the spatial filtering section 33 in accordance with the present embodiment is provided after the modulation processing section 32. Therefore, even if the spatial frequency of noise is close to that of ordinary video signal DAT, the spatial filtering section 33 will perform filtering after the difference between the spatial frequencies are increased by the modulation processing section 32.

Figure 11:
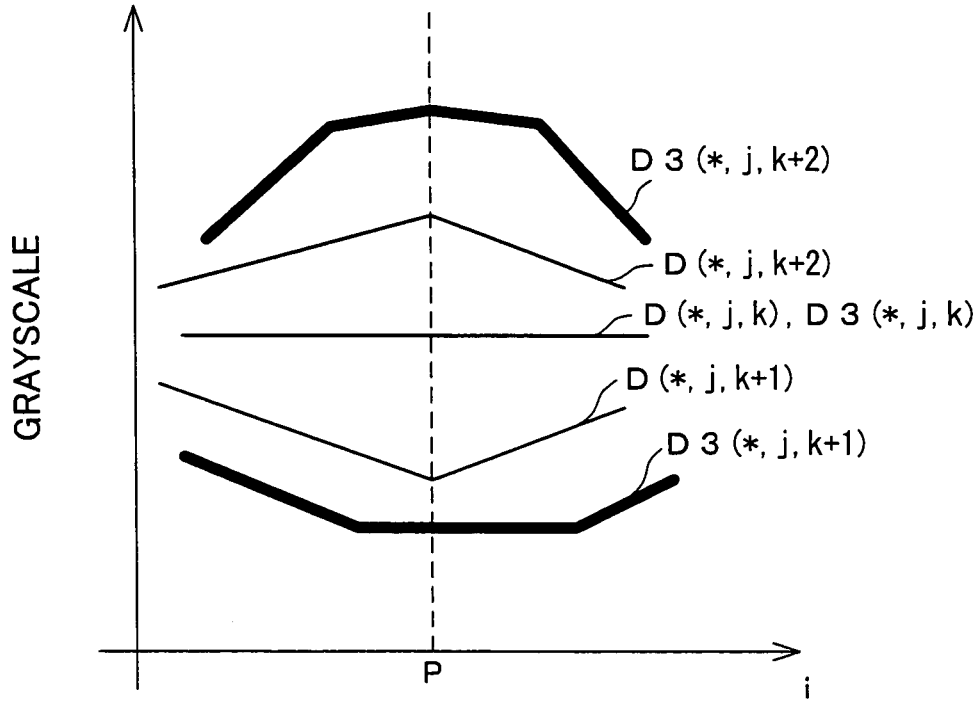
FIG. 11, illustrating operation of the embodiment, is a graph showing outputs from a modulated-drive processing section in accordance with the present embodiment upon receipt of the video signals.

Therefore, even if the spatial filtering section 33 performs filtering to the same extent as in FIG. 10, changes in the spatial domain of the video data D3(*,j,k+2) are, as shown in FIG. 11, will be gentler than those of the corrected video data D5(*,j,k+2) shown in FIG. 10. Thus, noise can be reduced or even removed by milder filtering than the comparative example in which the spatial filtering section 33 is provided before the modulation processing section 32. This reduces or even prevents undesirable or excess brightness from occurring across a wide range as shown in FIG. 14. As a result, in comparison to the comparative example, noise-caused grayscale level transition can be reduced or even eliminated without losing sharpness in the image.

The following will describe arrangement examples of the spatial filtering section 33 (first to fourth arrangement examples). The first arrangement example picks up data indicating an abnormal value off a mean for an area to brings it back to the mean.

To describe in more detail, in generating video data D3(i,j,k) for a pixel PIX(i,j), the spatial filtering section 33 designates as a determination area a square region {(i−a, j−a)−(i+a, j+a)} spanning 2a+1 dots in height and 2a+1 dots in width with the pixel PIX(i,j) at the center. Now, letting the same reference codes represent the grayscale levels indicated by both the video data D2 and D3, and C represent the abnormal/non-abnormal (acceptable/unacceptable) threshold value, the spatial filtering section 33 sets D3(i,j,k)=D2(i,j,k)

when abs(average(D2(x,y,k):(x=i−a . . . i+a, y=j−a . . . j+a))−D2(i,j,k))<C, and D3(i,j,k)=average(D2(x,y,k):(x=i−a . . . i+a, y=j−a . . . j+a))

when abs(average(D2(x,y,k):(x=i−a . . . i+a, y=j−a . . . j+a))−D2(i,j,k))>=C.

In the expressions, "abs" and "average" are functions referring to absolute value and mean, respectively. In addition, "a . . . b" represent a range of numeric values from a to b inclusive. "x:=a . . . b" represent repetition while x is varied from a to b. Therefore, average(D2(x,y,k):(x=i−a . . . i+a, y=j−a . . . j+a) represents a mean of grayscale levels indicated by the corrected video data D2 supplied to all the pixels PIX in the determination area.

In the arrangement, the spatial filtering section 33 picks up pixels PIX exhibiting an abnormal or unacceptable grayscale level off the mean over the determination area around the pixel PIX and brings the grayscale levels of the pixels PIX back to the mean, to generate video data D3 for the pixels PIX.

Therefore, it is especially suitably used with such video that it is known that when, for example, a video signal at the VGA (Video Graphics Array) resolution is displayed at the UXGA (Ultra eXtended Graphics Array) resolution, the original dot count is too small, and few changes take place in a particular area.

In the example, the original video signal is scaled up by about three folds. In a 3×3 dot area, the pixels exhibit the same grayscale level. The pixels rarely exhibit an excessively high grayscale level on a dot-to-dot basis. Therefore, as in the filtering, a simple filter is especially suitably used.

Note that the threshold value C may be set, for example, to a constant representing a grayscale level of about 16 to 32 which is perceived as an error. Alternatively, the value C may be set to a value in accordance with the brightness in the determination area (for example, a quarter of the mean).

The second arrangement example picks up an abnormal or unacceptable value off the mean over the determination area similar to the first arrangement example, but differs from the first arrangement example in that the second example equates the grayscale level of the picked-up pixel PIX to a mean over a narrower proximity area than the determination area in the proximity to the pixel PIX.

Specifically, the spatial filtering section 33 sets

D3(i,j,k)=D2(i,j,k)

when abs(average(D2(x,y,k):(x=i−a . . . i+a, y=j−a . . . j+a))−D2(i,j,k))<C, and D3(i,j,k)=average(D2(x,y,k):(x=i−b . . . i+b, y=j−b . . . j+b))

when abs(average(D2(x,y,k):(x=i−a . . . i+a, y=j−a . . . j+a))−D2(i,j,k))>=C. "b" is a smaller integer than "a", and the square region {(i−b,j−b)−(i+b,j+b)} spanning 2b+1 dots in height and 2b+1 dots in width with the pixel PIX(i,j) at the center is the proximity area. Here, if b is too large, the video signal may become blurred. It is therefore preferred if b is set to about 1 dot. Note that as will be detailed later, when the video signal is to be scale converted for display (for example, when an original signal is to be scaled up for display) this value is also preferably scaled up accordingly (for example, the value is scaled up at the same ratio as the scale up ratio for the original signal).

In the arrangement example, the grayscale level of the picked up pixel PIX is set to the mean over a narrower proximity area than the determination area in the proximity of the pixel PIX. Therefore, even when there are only a few pixels PIX in the determination area exhibiting values near the mean over the determination area, and the grayscale level distribution in the determination area shows concentrations at multiple (for example, two) isolated grayscale levels (for example, when an edge of a bright object on a dark background is to be specified as the determination area), the spatial filtering section 33 does not output grayscale levels hardly associated with the surroundings (grayscale levels scarcely found in the determination area). As a result, the display quality of the image display 1 is improved.

The third arrangement example simplifies the pick-up approach of the first and second arrangement examples. It picks up a pixel PIX exhibiting an abnormal value off at least one of two means over the straight line in the height direction and that in the width direction with the pixel PIX(i,j) at the midpoint.

Specifically, the spatial filtering section 33 sets

D3=D2(i,j,k) when

Condition 1: abs(average(D2(i, y, k):(y=j−a . . . j+a))−D2(*i,j*))<C, and

Condition 2: abs(average(D2(x,j,k):(x=i−a . . . i+a))−D2(i, j))<C are met, and otherwise, D3=average(D2(x,y,k):(x=i−b . . . i+b, y=j−b . . . j+b))

Here, since noise occurs unexpectedly, normally, the check of at least either the height direction or the width direction, i.e., without checking both, can determine whether an acceptable level of noise is present. Therefore, a pixel PIX where noise is present can be determined with less computation than in the first and second arrangement examples, where a check is done in both determination areas.

In the foregoing, the criterion was "true" or "false" of conditions 1 AND 2. Alternatively, the criterion may be that of condition 1 OR 2, or that of only one of the two conditions.

For such video that one of the conditions 1, 2 will be met even if no or an acceptable level of noise is present in one of the height and width directions (for example, relatively fine video), however, it is preferred if the determination is made based on whether both the conditions are true or not. In contrast, for such video that if one of the two conditions is met, the other condition is likely to be met. For example, for relatively coarse video, the determination may be made based on whether the condition 1 OR the condition 2 is true or based only on one of the conditions. As a result, the spatial filtering section 33 needs to perform less computation. When video of multiple types can be input, and suitable determination method varies depending on the type of video, determination methods may be used switchably in accordance with the video.

In addition, in the foregoing, an example was taken where the grayscale level of the picked up pixel PIX was set to a mean over a narrower proximity area than the determination area in the proximity to the pixel PIX, similarly to the second arrangement example. Alternatively, the grayscale level may be set to a mean over the determination area similarly to the first arrangement example. However, similarly to the second embodiment, setting the grayscale level to the mean over the proximity area better improves the display quality of the image display 1.

Further, a mean of the grayscale levels of the pixels PIX on a straight line spanning a length of 2a+1 or 2b+1 with the pixel PIX(i,j) at the midpoint may be used instead of the mean over the determination area or the proximity area. The straight line may be either in the height direction or the width direction. When a determination is made based only on one of the conditions 1, 2, the line preferably stretches in that direction.

Meanwhile, the fourth arrangement example differs from the first through third arrangement examples and determines whether to alter the grayscale level indicated by the video data D3 supplied to the pixel PIX, depending on whether the grayscale level of the pixel PIX is a peak value.

An example where only the width direction is used to determine a peak or an unacceptable value is taken here to illustrate the arrangement. The spatial filtering section 33 sets D3=D2(i,j,k) when average(D2(x,j,k):(x=i−a . . . i−1)−D2(i,j,k))×average(D2(x,j,k):(x=i+1 . . . i+a)−D2(i,j,k))<0, and otherwise D3=average(D2(x,y,k):(x=i−c . . . i+c))

In the expressions, c represents a constant determined by the type of video, that is, an expected spatial frequency. For example, for video with extremely high expected spatial frequency (the aforementioned video expected to assume local peaks on a dot-to-dot basis) c is extremely small: about 1 or 2 is preferably used. Meanwhile, for video with low expected spatial frequency (video to be scaled up), c is preferably from about 3 to 5.

The arrangement compares a right side mean and a left side mean of a target pixel PIX(i,j) in determination to determine whether the grayscale level of the target pixel PIX(i,j) is a local peak value. If the grayscale level is a local peak value, the video data D3(i,j,k) is set to a mean over b dots to the left and right of the target pixel.

Thus, abnormal or unacceptable grayscale levels are reduced or even eliminated. Further, even when a local peak value has occurred by chance in ordinary video, in the case of ordinary video, even a local peak value is generally somewhat continuous. Therefore, averaging to the left and right prevents an unnatural drop. As a result, the image display 1 has high display quality capability.

In the foregoing, the determination as to peak value solely depended on the width direction. Alternatively, the height direction or another direction may be involved in the determination as to peak value. Also in this case, noise generally occurs unexpectedly; therefore, noise is reduced or even removed, similar to the foregoing.

Alternatively, a determination may be made whether to alter the corrected video data D2(i,j,k), based on peak values in multiple directions, combination with a determination through comparison to a mean, or the AND or OR true/false value of these determinations as in the first through the third arrangement examples. In this case, a determination is made based on multiple conditions. Therefore, a more reliable determination is made whether to alter the corrected video data D2(i,j,k). In addition, in the foregoing, the video data D3(i,j,k) was altered to a mean in the width direction; a mean in the height direction or over an area may be used instead, with substantially similar accompanying effects.

Incidentally, in the foregoing, the determination area was, s an example, a (2a+1)×(2a+1) square. The embodiments of the invention are not limited to this. As mentioned earlier, noise can occur independent of scan direction. Noise identified in a direction is often determined so in another direction. Therefore, assuming a height of (2·a1+1) and a width of (2·a2+1), a "a1<a2" rectangle region or "a1>a2 rectangle region, for example, may be designated as the determination area. When the area is a square as in the arrangement examples above, however, accuracy in determination is independent of direction and therefore improved.

Meanwhile, when a horizontal scan is done, a line memory becomes necessary to compare the corrected video signal DAT2 in the height direction. If it is desirable to simplify the arrangement, a1<a2 is preferable. If a1=1, no line memory is needed, allowing for great simplification of the circuit arrangement.

Here, a2 may be set to any given value up to half the width (n) of the display screen of the image display 1. If a2 is too small, however, ordinary video signal DAT may be mistaken for noise. If it is too large, noise may not be removed. Therefore, the magnitude of a2 may be determined to a value selected in accordance with the type of the video signal DAT.

For example, general MPEG video is divided into multiple blocks and encoded block by block. As discussed in the foregoing, for video encoded block by block, a2 is preferably set to substantially the same value as the block size. For example, for MPEG video, the block size is 8×8 to 16×16. Therefore, in this case, a2 is preferably set to from about 4 to 8.

As discussed in the foregoing, setting the length of the longer side of the determination area to substantially the same value as the size of the encoding unit. The length of the longer side of the determination area may assume a value in accordance with the size handled integrally as video or the size at which noise becomes readily recognizable due to encoding unit. Thus, noise is thus accurately reduced or even removed.

In addition, when video signal is scale converted for display, as when displaying NTSC (National Television System Committee) video (640×480) on a display capable of high definition television (1920×1080; registered trademark) format for example, the scale conversion increases or decreases the block size. For example, in the example, the block size is scaled up by three folds to 24×24 to 48×48. Therefore, it is preferred if the length of the longer side of the determination area is accordingly scale converted to about 24 to 48, that is, a2=12 to 24.

Display affecting noise (unacceptable noise) may be present not only in the original signal (for example, MPEG), but also introduced in steps following scale conversion due to system factors. Here, if the region is scaled up by scale conversion, the area of noise per se may be scaled up. Therefore, it is preferred that the value of the upper limit is scaled up in accordance with the scale conversion as previously described as a preferred range. Meanwhile, when the pixel size does not decreases as much as the increase in resolution of the video signal, that is, when the spatial resolution does not improve in comparison to the increase in video resolution, small noise becomes more visible.

Therefore, when this is the case and if relatively large noise will likely be present in steps following scale conversion due to system factors, the value of the lower limit of the preferred range of the length of the longer side of the determination area may be set lower than the aforementioned value. For example, it can be set to about half that value, with the length of the determination area being set within the resulting range (for example, a2 is about 6 to 24).

In addition, the example assumed that the spatial filtering section 33 reduced or even eliminated a peak in the spatial domain of the corrected video signal DAT2 to restrain high frequency components. Alternatively, high frequency components may be reduced or restrained by, for example, decaying frequencies higher than a predetermined block frequency. This approach produces similar effects to the example.

Further, the embodiments assumed, as an example, that the display element was a liquid crystal cell of vertical align, normally black mode. The embodiments of the invention are not limited to this example. Substantially the same effects are achieved with any display element developing a difference between an actual grayscale level transition and a desired grayscale level transition because of slow response speed, even with such modulation/driving as to facilitate a previous-to-current grayscale level transition.

Note however that the response speed of the liquid crystal cell of vertical align, normally black mode is slower in a falling grayscale level transition than in rising transition. A difference between an actual grayscale level transition and a desired grayscale level transition is likely to occur even with such modulation/driving as to facilitate a previous-to-current falling grayscale level transition. In other words, excess or undesirable brightness is likely to occur due to a falling grayscale level transition followed by a rising grayscale level transition caused by noise. Therefore, the arrangement of the embodiments are especially effective if noise-caused grayscale level transition is reduced or prevented.

The embodiments assumed, as an example, that the members forming the modulated-drive processing section 21 are entirely made of hardware. The embodiments of the invention are not limited to the example. All or some of the members may be realized by a combination of computer programs realizing the aforementioned functions and hardware (computer) executing the programs.

For example, a computer may be connected to the image display 1 as a device driver driving the image display 1. Thus, a computer can effectively replace the modulated-drive processing section 21.

In addition, the modulated-drive processing section 21 may be provided in the form of a peripheral or built-in conversion board to the image display 1. If the operation of the circuit acting as the modulated-drive processing section 21 can be changed by rewriting the firmware or like program, the software may be distributed to change the operation of the circuit so that the circuit operates as the modulated-drive processing section of the embodiments.

In these cases, if hardware is prepared which is capable of executing the aforementioned functions, executing the program on the hardware alone may realize the modulated-drive processing section in accordance with the embodiments.

A method of driving a display, in accordance with an embodiment of the present invention, includes correcting a grayscale level of at least one pixel to facilitate a transition from a current grayscale level to a next grayscale level. The method further includes reducing high frequency components, in a spatial domain, of the corrected at least one pixel.

Another method of driving a display in accordance with an embodiment of the present invention includes correcting a grayscale level of at least one pixel to facilitate a transition from a current grayscale level to a desired grayscale level. The method further includes reducing a peak in a spatial domain of the corrected at least one pixel.

According to these arrangements, a transition from a current grayscale level to a next desired grayscale level is facilitated (via an overshoot driving method, for example) in a first correction step. Therefore, pixel response speed is improved. However, a change in grayscale level due to noise, if any, may be enhanced. Even when no noise is present in the next display, noise present this time may cause an undesired change in grayscale level.

According to the above arrangements, high frequency components in a spatial domain may be restrained by spatial (for example low pass) filtering and peak reducing or even removing, carried out after the first correction step. Therefore, pixel response speed is still improved, while undesirable noise-caused grayscale level change is also reduced or restrained, resulting in a display of ordinary video with no or virtually no undesirable noise present.

In addition, high frequency components caused by noise in a spatial domain of the grayscale levels of the pixel(s) may be reduced or restrained in the second step after the components' frequencies are potentially raised in the first correction step. As discussed in the foregoing, the high frequency components may be reduced or restrained after the difference in spatial frequency between the ordinary video and the noise is scaled up. Therefore, noise is reduced or even removed without interrupting the display of ordinary video in comparison to the second step being implemented before the first correction step.

As a result, a display may be realized which is capable of reducing or even preventing noise-caused display quality degradation, while improving pixel response speed.

Another method of driving a display in accordance with an embodiment of the present invention includes correcting a grayscale level of at least one pixel to facilitate a transition from a current grayscale level to a next grayscale level. The method includes calculating a first mean of corrected grayscale levels of a first group of pixels in proximity to the at least one corrected pixel. Further, the method includes calculating a second mean of corrected grayscale levels of a second group of pixels in proximity to a corrected pixel determined to have an unacceptable grayscale level, upon the first mean differing from a grayscale level of the corrected pixel by more than a threshold value; and changing the unacceptable grayscale level to a grayscale level equal to the second mean.

The second group of pixels may be the same group as the first group of pixels or a group located more proximate to the target pixel (having a relatively unacceptable grayscale level) in correction than is the first group of pixels. Besides, the first group of pixels may be located in a rectangle having a center at the specific pixel or on a segment having a midpoint at the specific pixel.

With these arrangements, high frequency components in a spatial domain of the grayscale levels of the pixels corrected in the first correction step are reduced in a later step, carried out after the first correction step. Therefore, similar to the aforementioned methods of driving a display, a display is realized which is capable of reducing or even preventing noise-caused display quality degradation, while maintaining improved pixel response speed.

Further, in addition to the arrangement, the second group of pixels may be located more closely to the specific pixel than is the first group of pixels. The arrangement determines whether the target pixel (having a relatively unacceptable grayscale level) in correction is a specific pixel based on a determination with reference to the grayscale levels of the first group of pixels. If the grayscale levels need to be changed, it changes the grayscale level of the specific pixel to a mean grayscale level of the second group of pixels (second mean), which is closer to the specific pixel than is the first group of pixels. Therefore, even with relatively fine video, the specific pixel is reduced or even prevented from showing a grayscale level bearing no correlation to the surroundings at all, improving display quality.

In addition to the arrangement, the first group of pixels may be located on a segment having a midpoint at the specific pixel. The arrangement calculates a first mean of grayscale levels of the pixels on the segment, and therefore involves less computation than an arrangement calculating a first mean of grayscale levels of the pixels in a rectangle. Since noise occurs unexpectedly, even if the first group of pixels are on a segment, unacceptable noise-caused display quality degradation is reduced or restrained, similar to a case of a rectangle.

The determination step may be replaced with the determination step of, for each one of the pixels, identifying a first group of pixels located on a segment having a midpoint at that one of the pixels, and calculating a mean difference in grayscale level between that pixel and those of the first group of pixels located to one direction to the pixel and a mean difference in grayscale level between the pixel and those of the first group of pixels located to another direction of the pixel, so as to determine whether the mean differences have different signs.

With the arrangement, the second correction step, carried out after the first correction step, again reduces or restrains high frequency components in a spatial domain of the grayscale levels of the pixels corrected in the first correction step. Therefore, a display is realized capable of reducing or even preventing undesirable noise-caused display quality degradation, while maintaining improved pixel response speed similar to the aforementioned method of driving a display.

In addition to the arrangement, the second group of pixels may be located on a shorter segment having a midpoint at the pixel than is the first group of pixels.

The arrangement determines whether the target pixel in correction is a specific pixel based on a determination with reference to the grayscale levels of the first group of pixels, and if the grayscale levels need to be changed, changes the grayscale level of the specific pixel to a mean grayscale level of the second group of pixels (second mean), which is closer to the specific pixel than is the first group of pixels. Therefore, even with relatively fine video, the specific pixel is reduced or even prevented from showing a grayscale level bearing no correlation to the surroundings at all, improving display quality.

In addition to the arrangement, there may be multiple first groups of pixels located on respective segments in differing directions having a common midpoint at the specific pixel, the determination step being repeated for each of the first groups of pixels. Further, the second correction step may designate as the specific pixel a pixel determined in the determination step to have an unacceptable or excessive grayscale level according to a combination of determinations with respect to the directions.

The arrangement determines whether the target pixel in correction shows a grayscale level according to a combination of determinations with respect to the directions, thereby more reliably identifying the specific pixel than with a determination with respect to a single direction. As a result, undesirable noise-caused display quality degradation is reduced or restrained more reliably.

In addition to the arrangement, the signal corrected in the first correction step may be a video signal divided into multiple blocks encoded block by block, for example, in the MPEG (Moving Picture Expert Group) format. Further, the first group of pixels may have substantially as long a longer side as do the blocks. If the video signal encoded on a block-to-block basis is scaled up for display, the blocks, or encoding units, are also scaled up; the length of the longer side of the first group of pixels is specified accordingly.

According to the arrangement, the encoding unit (the size of video data forming a meaningful unit or producing easily visible noise) has as long a longer side as does the first group of pixels. Therefore, it is more accurately determined whether the target pixel in correction is a specific pixel. As a result, undesirable noise-caused display quality degradation is reduced or restrained more reliably.

A display in accordance with an embodiment of the present invention includes a first correction section, adapted to correct a grayscale level of at least one pixel to facilitate a transition from a current grayscale level to a desired grayscale level. It further includes a second correction section, adapted to reduce high frequency components in a spatial domain of the corrected at least one pixel.

Another display in accordance with an embodiment of the present invention includes a first correction section correcting a grayscale level of at least one pixel to facilitate a transition from a current grayscale level to a next grayscale level. It further includes a second correction section comparing the grayscale levels of the pixels corrected by the first correction section to reduce or even remove a peak in a spatial domain.

Another display in accordance with an embodiment of the present invention includes a first correction section, adapted to correct a grayscale level of at least one pixel to facilitate a transition from a current grayscale level to a desired grayscale level. It further includes a second correction section, adapted to reduce an unacceptable peak in a spatial domain of the corrected at least one pixel.

Another display in accordance with an embodiment of the present invention includes a first correction section, adapted to correct a grayscale level of at least one pixel to facilitate a transition from a current grayscale level to a desired grayscale level. It further includes a determination section, adapted to calculate a first mean of corrected grayscale levels of a first group of pixels in proximity to the corrected at least one pixel and adapted to determine whether the corrected at least one pixel has an unacceptable grayscale level, upon the first mean differing from a grayscale level of the corrected at least one pixel by more than a threshold value. Finally, it includes a second correction section, adapted to calculate a second mean of corrected grayscale levels of a second group of pixels in proximity to the corrected at least one pixel, upon the determination section determining that the corrected at least one pixel has an unacceptable grayscale level, and adapted to change the unacceptable grayscale level of the corrected at least one pixel, to a grayscale level equal to the second mean.

In addition to the arrangement, the second group of pixels may be located more closely to the specific pixel than is the first group of pixels.

According to an arrangement, the determination section determines whether the target pixel in correction is a specific pixel determined by the determination section to have an undesirable or excessive grayscale level, according to a determination with reference to the grayscale levels of the first group of pixels. If the grayscale levels need to be changed, the second correction section changes the grayscale level of the specific pixel to a mean grayscale level of the second group of pixels (second mean), which is closer to the specific pixel than is the first group of pixels. Therefore, even with relatively fine video, the specific pixel is prevented from showing a grayscale level bearing no correlation to the surroundings at all, improving display quality.

In addition to the arrangement, the first group of pixels may be located on a segment having a midpoint at the specific pixel.

According to an arrangement, the determination section calculates a first mean of the grayscale levels of the pixels on the segment. The arrangement therefore involves less computation in comparison to the calculation of a first mean of the grayscale levels of the pixels in a rectangle. Since noise occurs unexpectedly, even if the first group of pixels are on a segment, noise-caused display quality degradation is restrained similarly to a case of a rectangle.

The display in accordance with an embodiment of the present invention includes a first correction section, adapted to correct a grayscale level of at least one pixel to facilitate a transition from a current grayscale level to a next grayscale level; a determination section, adapted to calculate a mean difference in grayscale level between the at least one pixel and a plurality of pixels of a first group of pixels, located on a segment having a midpoint at the at least one pixel and located to one direction of the at least one pixel, and adapted to calculate a mean difference in grayscale level between the at least one pixel and a plurality of the first group of pixels located to another direction of the at least one pixel, and adapted to determine that the at least one pixel has an unacceptable grayscale level upon the mean differences having different signs; and a second correction section, adapted to calculate a second mean of corrected grayscale levels of a second group of pixels in proximity to the at least one pixel upon the at least one pixel being determined to have an unacceptable grayscale level and adapted to change unacceptable grayscale level to a grayscale level equal to the second mean.

The display thus arranged, can drive pixels with any of the aforementioned methods of driving a display. Therefore, a display may be realized which is capable of reducing or even preventing noise-caused display quality degradation despite improved pixel response speed similarly to the aforementioned method of driving a display.

In addition to the arrangement, the second group of pixels may be located on a shorter segment having a midpoint at the pixel than is the first group of pixels.

According to the arrangement, the determination section determines whether the target pixel in correction is a specific pixel according to a determination with reference to the grayscale levels of the first group of pixels. If the grayscale levels need to be changed, the second correction section changes the grayscale level of the specific pixel to a mean grayscale level of the second group of pixels (second mean), which is closer to the specific pixel than is the first group of pixels. Therefore, even with relatively fine video, the specific pixel is reduced or even prevented from showing a grayscale level bearing no correlation to the surroundings at all, thus improving display quality.

In addition to the arrangement, there may be multiple first groups of pixels located on respective segments in differing directions having a common midpoint at the specific pixel. The determination section repeats determination for each of the first groups of pixels; and the second correction section may designate as the specific pixel a pixel determined by the determination section to have an excessive grayscale level according to a combination of determinations with respect to the directions.

According to an arrangement, the determination section determines whether the target pixel in correction has an excessive grayscale level according to a combination of determinations with respect to multiple directions. Therefore, the determination section more reliably identifies a specific pixel than with a determination with respect to a single direction. As a result, noise-caused display quality degradation is restrained more reliably.

In addition, video may be divided into multiple blocks encoded block by block and fed as a video signal to the first correction section; and the first group of pixels may have substantially as long a longer side as do the blocks.

According to an arrangement, the determination section may more accurately determine whether the target pixel in correction is a specific pixel because the encoding unit is substantially equal to the length of a longer side of the first group of pixels. Noise-caused display quality degradation is thereby more reliably reduced or restrained.

In addition to an arrangement, the pixels may be liquid crystal elements of normally black, vertical align mode. When this is the case, the response speed is lower in a falling grayscale level transition than in a rising transition. A difference between an actual grayscale level transition and a desired grayscale level transition is likely to occur even with such modulation/driving as to facilitate a previous-to-current falling grayscale level transition. In other words, undesirable brightness is likely to occur and be readily visible to the user due to a falling grayscale level transition followed by a rising grayscale level transition caused by noise.

Alternatively, according to an arrangement, the second correction section may be placed after the first correction section to reduce or restrain noise-caused grayscale level transition. Therefore, despite the fact that the pixel is a liquid crystal element of normally black, vertical align mode, noise-caused undesirable brightness may be prevented from occurring and improves display quality.

Data, such as video signal data for example, for a next desired frame may therefore be modulated or varied to facilitate a transition from a current frame to a next desired frame. A modulation processing section can be used, for example, to thus produce a corrected video signal to facilitate the current-to-next desired grayscale level transition. Meanwhile, a spatial filtering section for example, after the modulation processing section, carries out spatial filtering on the corrected video signal. As such, high frequency components in a spatial domain may be reduced, even after the spatial frequencies of an ordinary video signal and potentially those of noise have been scaled up. Therefore, undesirable noise-caused display quality degradation can be reduced or even prevented, while pixel response speed, as a result of the facilitation of grayscale level transition, is improved.

A program in accordance with an embodiment of the present invention includes a program causing a computer to execute the steps constituting any of the aforementioned methods of driving a display. Such a computer running the program may operate as a driver for the display. Therefore, a display may be realized capable of reducing or even preventing noise-caused display quality degradation despite improved pixel response speed similarly to an aforementioned method of driving a display.

Any and all of these programs may be represented as a computer data signal. For example, if a computer receives the computer data signal embodied in a signal (for example, a carrier wave, sync signal, or any other signal) and runs a program, the computer may drive the display with any of the drive methods.

Any of these programs, when recorded on a computer readable storage medium, may be readily stored and distributed.

A computer reading the storage medium, may drive the display with any of the drive methods.

In another embodiment, a method of driving a display includes correcting a grayscale level of at least one pixel to facilitate a transition from a current grayscale level to a desired grayscale level; and spatial filtering the corrected at least one pixel. The grayscale level of at least one pixel may be increased to facilitate a transition from a current grayscale level to a desired grayscale level. Further, the grayscale level may be increased from a desired grayscale level to facilitate a transition from a current grayscale level to a desired grayscale level.

In another embodiment, a program is adapted to cause a computer to execute correcting a grayscale level of at least one pixel of a display to facilitate a transition from a current grayscale level to a desired grayscale level; and to execute spatial filtering the corrected at least one pixel. A computer signal may embody or include the program. Further, a computer readable medium may also embody or include the program. Additionally, a computer readable medium may be adapted to cause a computer to perform the aforementioned method.

Such a computer running the program may operate as a driver for the display. Therefore, a display may be realized capable of reducing or even preventing noise-caused display quality degradation despite improved pixel response speed similarly to an aforementioned method of driving a display.

In another embodiment, a display includes a correction section, adapted to correct a grayscale level of at least one pixel to facilitate a transition from a current grayscale level to a desired grayscale level. It further includes a filter, adapted to spatially filter the corrected at least one pixel. Alternatively, the display may include any device for correcting a grayscale level of at least one pixel to facilitate a transition from a current grayscale level to a desired grayscale level; and any device for spatially filtering the corrected at least one pixel. The device for correcting may include overshoot driving of the display. Further, the device for correcting may be for increasing a grayscale level of at least one pixel to facilitate a transition from a current grayscale level to a desired grayscale level.

In another embodiment, a method of driving a display includes determining a signal for driving at least one pixel to produce a desired grayscale level from a current grayscale level; and spatial filtering the at least one pixel. A grayscale level of the signal may be increased from a desired grayscale value to facilitate a transition from a current grayscale level to a desired grayscale level.

In another embodiment, a program may be adapted to cause a computer to execute both determining a signal for driving at least one pixel to produce a desired grayscale level from a current grayscale level, and spatial filtering the at least one pixel. A computer signal may embody or include the program. Further, a computer readable medium may embody or include the program.

Such a computer running the program may operate as a driver for the display. Therefore, a display may be realized capable of reducing or even preventing noise-caused display quality degradation despite improved pixel response speed similarly to an aforementioned method of driving a display.

In another embodiment, a display includes a device, adapted to determine a signal for driving at least one pixel to produce a desired grayscale level from a current grayscale level. It further includes a filtering device, adapted to spatially filter the at least one pixel.

In another embodiment, a display includes a device for determining a signal for driving at least one pixel to produce a desired grayscale level from a current grayscale level; and a device for spatially filtering the at least one pixel. The device for determining may include a device for determining an overshoot driving signal for the display. Further, the device for determining may be for increasing a grayscale level of the signal from a desired grayscale value to facilitate a transition from a current grayscale level to a desired grayscale level.

Finally, throughout the embodiments described above, correcting a grayscale level of at least one pixel to facilitate a transition from a current grayscale level to a next grayscale level has been described broadly. This is intended to include various driving techniques, including overshoot driving techniques wherein a driving signal may be corrected, modulated or varied if needed (wherein additional voltage/current may be added, if necessary) to permit display of a desired next grayscale value of a pixel, from display of a current grayscale value of a pixel. The display may be a display of variable response, such as a liquid crystal display. The driving signal may be corrected, modulated or varied from a desired grayscale value to account for inherent delays in the liquid crystal structure, to improve display and to permit a display reflecting the desired grayscale value. This is intended to include various overshoot driving techniques where the grayscale level is increased from a desired grayscale level to facilitate a transition from a current grayscale level to a desired grayscale level.

An example in FIG. 1 shows a modulating processing section 32 which varies the drive signal for pixel display, based upon a current and next desired grayscale signal, to facilitate a transition from a current grayscale level to a desired grayscale level. Such a modulation processing section should not be limited as such and should be understood, for all embodiments of the invention, to also include any type of overshoot driving device. For example, the modulation processing device can be an overshoot driving device which can vary the drive signal based upon the current and next desired grayscale signals for driving a pixel, or based upon the next desired grayscale signal and a corrected current grayscale signal, obtained using the current grayscale signal and a signal previous to the current signal. The corrected current grayscale signal can be obtained using transitions from the previous and current grayscale levels, using actual values of the current and previous grayscale levels, etc.

Further, the modulation processing device can either apply a varied or modulated driving signal based on the desired next grayscale signal or signal value and one of the current or corrected current signals or signal values, or can select a predetermined drive signal based only on the desired next signal or signal value and/or a transition from the current or corrected current value to the next desired signal value. The grayscale level or value of the overshoot driving signal produced is typically increased from a desired grayscale level to facilitate a transition from a current grayscale level to a desired grayscale level.

Further, it should be understood that each of the embodiments of the present invention are not limited to the configuration shown in FIG. 1, wherein the current grayscale signal is stored in a frame memory. Any technique wherein the current signal/value and/or a previous signal/value and/or a transition between any of a previous/current/next desired signal is stored temporarily, in a frame memory or otherwise may apply to each of the embodiments of the present application. The embodiments of the invention may apply to any situation where some overshoot driving technique is applied using any of the above which may create and/or emphasize undesirable noise, and wherein spatial filtering is applied thereafter.

As examples of various modulation processing devices and overall modulation configurations to which the embodiments of the present invention apply, reference is made to co-pending and commonly assigned U.S. patent application Ser. No. 10/679,477 by Shiomi et al., filed Oct. 7, 2003 and entitled "METHOD OF DRIVING A DISPLAY, DISPLAY, AND COMPUTER PROGRAM FOR THE SAME; co-pending and commonly assigned U.S. patent application Ser. No. (not yet assigned) by Shiomi et al., filed on even date with the present application and entitled "METHOD OF DRIVING A DISPLAY, DISPLAY, AND COMPUTER PROGRAM THERFOR. The entire contents of each of the above commonly assigned applications are hereby incorporated by reference herein.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a display, comprising:

correcting a grayscale level of at least one pixel to facilitate a transition from a current grayscale level to a desired grayscale level;

reducing high frequency components in a spatial domain of the corrected at least one pixel;

calculating a first mean of corrected grayscale levels of a first group of pixels in proximity to the at least one corrected pixel;

calculating a second mean of corrected grayscale levels of a second group of pixels in proximity to a corrected pixel determined to have an unacceptable grayscale level, upon the first mean differing from a grayscale level of the corrected pixel by more than a threshold value; and changing the unacceptable grayscale level to a grayscale level equal to the second mean.

2. The method of claim 1, wherein the second group of pixels is relatively closer to the corrected pixel determined to have an unacceptable grayscale level, than is the first group of pixels.

3. The method of claim 1, wherein the first group of pixels is located on a segment having a midpoint at the corrected pixel determined to have an unacceptable grayscale level.

4. A method of driving a display, comprising:

correcting a grayscale level of at least one pixel to facilitate a transition from a current grayscale level to a desired grayscale level, the correcting including correcting a grayscale level of at least one pixel to facilitate a transition from a current grayscale level to a next grayscale level;

reducing high frequency components in a spatial domain of the corrected at least one pixel;

calculating a mean difference in grayscale level between the at least one pixel and a plurality of pixels of a first group of pixels, located on a segment having a midpoint at the at least one pixel and located to one direction of the at least one pixel, calculating a mean difference in grayscale level between the at least one pixel and a plurality of the first group of pixels located to another direction of the at least one pixel, and determining that the at least one pixel has an unacceptable grayscale level upon the mean differences having different signs;

calculating a second mean of corrected grayscale levels of a second group of pixels in proximity to the at least one pixel upon the at least one pixel being determined to have an unacceptable grayscale level; and changing the unacceptable grayscale level to a grayscale level equal to the second mean.

5. The method of claim 4, wherein the second group of pixels is located on a relatively shorter segment having a midpoint at the pixel, than the first group of pixels.

6. The method of claim 1, wherein there are multiple first groups of pixels located on respective segments in differing directions having a common midpoint at the specific pixel, wherein a calculation of a first mean of corrected grayscale levels is repeated for each of the first groups of pixels, and wherein a determination of whether or not the corrected pixel has an unacceptable grayscale level is made according to a combination of determinations with respect to the directions.

7. The method of claim 1, wherein a video signal for the at least one pixel corrected in the first correction step is a video signal divided into multiple blocks and wherein the first group of pixels has substantially as long a relatively longer side, as the blocks.

8. A display, comprising:

a first correction section, adapted to correct a grayscale level of at least one pixel to facilitate a transition from a current grayscale level to a desired grayscale level;

a second correction section, adapted to reduce high frequency components in a spatial domain of the corrected at least one pixel; and a determination section, adapted to calculate a first mean of corrected grayscale levels of a first group of pixels in proximity to the corrected at least one pixel and adapted to determine whether the corrected at least one pixel has an unacceptable grayscale level, upon the first mean differing from a grayscale level of the corrected at least one pixel by more than a threshold value; wherein the second correction section is further adapted to calculate a second mean of corrected grayscale levels of a second group of pixels in proximity to the corrected at least one pixel, upon the determination section determining that the corrected at least one pixel has an unacceptable grayscale level, and adapted to change the unacceptable grayscale level of the corrected at least one pixel, to a grayscale level equal to the second mean.

9. The display of claim 8, wherein the second group of pixels is located relatively closer to the at least one corrected pixel than the first group of pixels.

10. The display of claim 8, wherein the first group of pixels is located on a segment having a midpoint at the at least one corrected pixel.

11. A display, comprising:

a first correction section, adapted to correct a grayscale level of at least one pixel to facilitate a transition from a current grayscale level to a next grayscale level;

a second correction section, adapted to reduce high frequency components in a spatial domain of the corrected at least one pixel; and a determination section, adapted to calculate a mean difference in grayscale level between the at least one pixel and a plurality of pixels of a first group of pixels, located on a segment having a midpoint at the at least one pixel and located to one direction of the at least one pixel, and adapted to calculate a mean difference in grayscale level between the at least one pixel and a plurality of the first group of pixels located to another direction of the at least one pixel, and adapted to determine that the at least one pixel has an unacceptable grayscale level upon the mean differences having different signs, wherein the second correction section is further adapted to calculate a second mean of corrected grayscale levels of a second group of pixels in proximity to the at least one pixel upon the at least one pixel being determined to have an unacceptable grayscale level and adapted to change unacceptable grayscale level to a grayscale level equal to the second mean.

12. The display of claim 11, wherein the second group of pixels is located on a relatively shorter segment having a midpoint at the pixel, than the first group of pixels.

13. The display of claim 8, wherein multiple first groups of pixels are located on respective segments in differing directions having a common midpoint at the specific pixel, the determination section being adapted to repeat the calculations for each of the first groups of pixels; and wherein the second correction section is adapted to determine the at least one pixel to have an unacceptable grayscale level according to a combination of calculations with respect to the directions.

14. The display of claim 8, wherein a video signal for the at least one pixel corrected in the first correction section is a video signal divided into multiple blocks and wherein the first group of pixels has substantially as long a relatively longer side, as the blocks.

15. The display of claim 8, wherein the display is a liquid crystal display and the at least one pixel includes at least one liquid crystal element of a liquid crystal display of a normally black, vertical align mode.

16. The display of claim 11, wherein the display is a liquid crystal display and the at least one pixel includes at least one liquid crystal element of a liquid crystal display of a normally black, vertical align mode.

17. The method of claim 1, wherein the grayscale level is increased from a desired grayscale level to facilitate a transition from a current grayscale level to a desired grayscale level.

18. The method of claim 4, wherein the grayscale level is increased from a desired grayscale level to facilitate a transition from a current grayscale level to a desired grayscale level.

* * * * *

UNITED STATES PATENT AND TRADEMARK OFFICE

CERTIFICATE OF CORRECTION

PATENT NO. : 7,583,278 B2
APPLICATION NO. : 10/743770
DATED : September 1, 2009
INVENTOR(S) : Shiomi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1182 days.

Signed and Sealed this

Fourteenth Day of September, 2010

David J. Kappos

David J. Kappos
*Director of the United States Patent and Trademark Office*